US005786761A

United States Patent [19]

Hui

[11] Patent Number: 5,786,761

[45] Date of Patent: Jul. 28, 1998

[54] GATE OPENING ALARM WITH RESETTING DISABLE MEANS

[76] Inventor: Joseph W. T. Hui, 140-B S. Whisman Rd., Mountain View, Calif. 94041

[21] Appl. No.: 853,599

[22] Filed: May 9, 1997

[51] Int. Cl.[6] ..... G08B 13/08

[52] U.S. Cl. ..... 340/547; 340/514; 340/546; 340/636; 340/693

[58] Field of Search ..... 340/545, 546, 340/693, 514, 636, 547

[56] References Cited

U.S. PATENT DOCUMENTS

| | | | |
|---|---|---|---|
| 3,943,499 | 3/1976 | Dunphy | 340/693 |
| 4,462,023 | 7/1984 | Nielsen et al. | 340/693 |
| 4,660,027 | 4/1987 | Davis | 340/636 |
| 5,450,064 | 9/1995 | Williams, Jr. et al. | 340/693 |
| 5,473,310 | 12/1995 | Ko | 340/547 |
| 5,574,429 | 11/1996 | Streeter | 340/693 |

*Primary Examiner*—Glen Swann

*Attorney, Agent, or Firm*—John R. Duncan; Frank D. Gilliam

[57] ABSTRACT

A gate opening alarm for swimming pool fences and the like will sound an audible alarm when the gate is opened without first pressing a reset/pass switch button that is mounted out of children's reach. An alarm housing and a magnetically actuatable switch are mounted on either the gate or frame, with a permanent magnet mounted closely adjacent to the switch on the other gate component so that they will be separated when the gate is opened. A reset switch button is provided so that an adult may disable the alarm for a short period to pass though the gate. If the gate is not then closed, the alarm will sound. Opening the gate without pressing the reset button will cause the alarm to immediately sound. The switch is rearmed when the gate is closed after opening or after a short period if the reset button is pushed but the gate is not opened. If the gate is left opened, the alarm will sound for a period of typically 3 minutes, then will stop to check whether the gate has been closed. If the gate remains open, the alarm will again sound and the cycles of alarm and checking will continue indefinitely. Three mounting arrangements for the components are provided, one using screws for use on softer material such as wood, a strap arrangement for use with metal gates and double sided foam tape for any surface.

18 Claims, 3 Drawing Sheets

GATE OPENING ALARM WITH RESETTING DISABLE MEANS

FIELD OF THE INVENTION

This invention relates to apparatus for sounding an audible alarm immediately signaling that a gate or other entrance into a swimming pool area or other potentially dangerous area has been opened.

BACKGROUND OF THE INVENTION

Precautions must be taken to prevent entry by unauthorized persons and/or to warn of such entry, in particular by small children into a swimming pool area. Governmental agencies generally require a number of precautions, such as fences. Further, liability insurance companies require, or at least grant lower premiums, to pool owners that take reasonable precautions to warn of unauthorized entry.

A wide variety of protective devices are in use, including fences, locked gates, proximity alarms, pool covers, etc. Often, gates or other entrances are kept locked and only adults and older children are given keys. However, a younger child may accidently be given access to a key, or someone may unlock the gate and forget to relock it upon leaving. While self-locking latches are generally required, there is no way to tell if the latch is working properly. If not latched properly the gate can be easily opened and may even be blown open by the wind.

Thus, there is a continuing need for improved alarm systems for warning when a gate or other entrance is opened, that are inexpensive, easy to use and reliable and cannot be easily circumvented by small childern

SUMMARY OF THE INVENTION

The above-noted problems, and others, are overcome by the gate opening alarm for use with swimming pool enclosures or other entrances into dangerous areas. Basically, this alarm is made in several parts. A first highly water resistant body housing contains the electronic control and alarm components and bears a pass/reset button and a battery check button. A permanent magnet is contained in a housing that has attachment means for fastening the magnet housing to one of a gate frame and gate. A magnetically actuated switch, (typically a reed switch or any other device that will transmit a suitable signal) wired to the body housing, is contained in a housing that has attachment means for fastening the switch housing to a gate frame or gate adjacent to the magnet housing so that the magnet and switch housings move apart when the gate is opened, changing the state of the switch and actuating the alarm, as detailed below.

The alarm body housing includes releasable means for fastening the body housing onto a mounting bracket that is secured to the gate or gate frame. The gate may be an entrance into a swimming pool, or other potentially dangerous area, such as a spa room, a front yard gate to the street, an electrical fuse box, pump rooms, etc. While a swimming pool gate is described in the description of preferred embodiments, it should be understood that the alarm can be used on any suitable entrance.

Preferably, the alarm body includes tongues that fit into corresponding slots in the mounting bracket. The mounting bracket is secured by screws threaded into the gate or gate frame or attachment straps that pass through openings in the bracket and around a portion of the gate or gate frame. The mounting bracket can be left permanently in place and the alarm body can be removed from the bracket for battery replacement. The housing is weather proof, with sealed switches and a gasket sealing the battery replacement cover. The housing is placed at a height above ground such that small children cannot reach the control buttons on the body housing.

The magnet and switch housings may be directly secured to adjacent sides of the gate and gate frame by screws passing though the housings. Alternately, the magnet and switch housings may each be secured to a pedestal by screws, with slots in the pedestals accommodating straps that pass through the slots and around a portion of the gate or gate frame to secure the housings in place closely adjacent to each other.

The battery is connected to the alarm circuitry without a switch, so that the alarm is always powered and cannot be disabled.

If the gate is opened, separation of the magnet from the closed position adjacent to the reed switch will cause a change of state in the switch. A normally closed reed switch will be maintained in the open position when adjacent to the magnet. Opening of the gate then will cause the switch to return to the normal closed position, actuating the alarm. If desired, a normally open switch could be used, with a relatively weak magnet in the switch housing causing the switch to close when away from the stronger magnet in the housing and activate the alarm. When the magnet housing is adjacent to the switch housing, the stronger magnet will overcome the force of the weak magnet, causing the switch to open, keeping the alarm in the standby mode. While a normally open reed switch is preferred, any other signaling element that will respond to the presence and absence of the magnetic field and send a corresponding signal to a microprocessor controlling operation of the alarm may be used.

A pass/reset button on the body housing, when pressed, disables the alarm for a predetermined time period, such as 7 seconds to permit an adult to pass through. If the gate is left open, after expiration of the time period, the alarm will sound for a predetermined period, such as 3 minutes. After that period, the alarm will shut off for a brief predetermined time period, such as 2 seconds and the microprocessor will check the reed switch state. If the reed switch state corresponds to a closed gate, the alarm will return to the standby mode. If the gate remains open, the alarm will continue to cycle through the 3 minutes on, 2 second reed switch checking, sequence. While some prior alarms permitted the gate to be opened for up to 10 seconds before the alarm begins to sound, I have found this delay to be very dangerous, since a child can be easily injured during that period, in particular where the alarmed entrance admits the child into an electrically dangerous area, directly onto a busy street, etc.

If the gate is opened without pressing the pass/reset button, the alarm will always sound. If the gate is momentarily opened even for a very short time, such as less than 3 seconds, and immediately closed, the alarm will still sound for a predetermined time, such as 3 minutes, then return to the standby mode.

A battery and alarm check button is also included on the alarm housing. Pressing this button will sound the alarm for the period the button is held down if the battery is still good and installed properly. Raised indicia, such as different patterns of narrow bumps, are preferably provided adjacent to the pass/reset and battery check buttons to aid in finding the desired button in the dark by feel.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
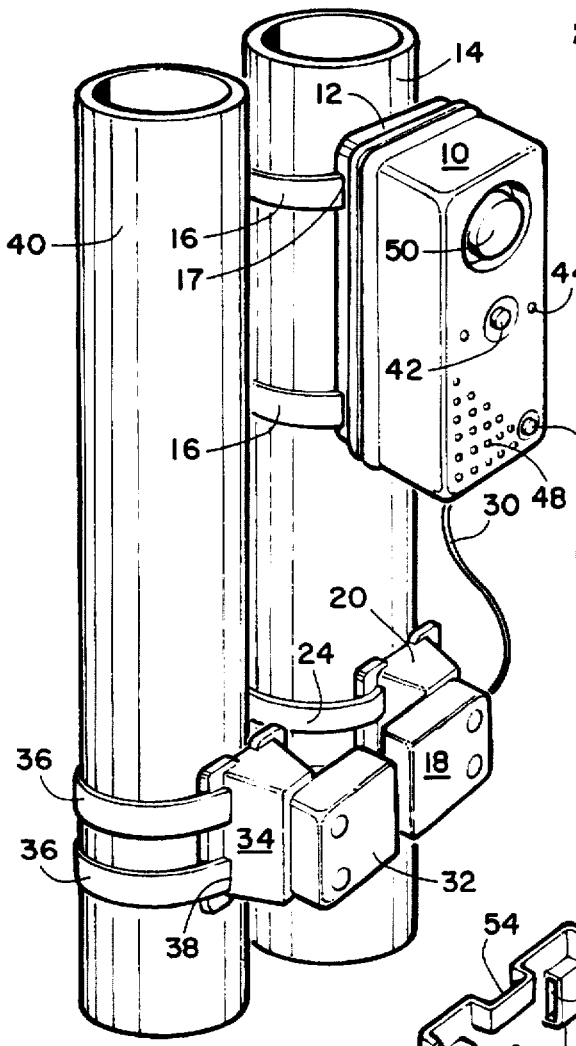
FIG. 1 is a perspective view of the entire alarm mounted on a gate and adjacent gate frame.

Referring to FIG. 1, there is seen an alarm housing 10 mounted via a bracket 12 on either a tubular portion of a gate or the gate frame 12. In the embodiment shown in FIG. 1, the gate and frame are formed from metal tubes, so that screw-mounting the components would be difficult. In the shown embodiment, straps (such as nylon cable ties) 16 pass through slots 17 in bracket 12 and around tube 14 and are fastened together tightly to hold the alarm at the desired height on tube 14, sufficiently high to prevent a child under a selected age from reaching the alarm housing 10. While any suitable strap could be used, conventional straps of the sort used to tie bundles of electrical wires and the like together are preferred. Such straps or ties have a rectangular tube at one end of the strap with ratchet-like internal edges that engage and restrain the transversely grooved other end of the strap.

In addition, bracket 12 may be mounted on a gate frame with double sided foam tape, if desired.

A switch housing 18 (as detailed in FIG. 2) containing a conventional reed switch (not shown) is secured to a pedestal 20 by screws 22. Pedestal 20 is secured by straps 24 of the sort described above to tube 14 with the straps extending through transverse slots 25. Recessed screw holes 26 in switch housing 18 may be covered by plugs 28 for appearance reasons. If desired switch housing 18 could be secured to gate frame 14 with double sided foam tape.

A wire 30 is connected between the reed switch in housing 18 and alarm control electronic components within alarm housing 16, as detailed in FIG. 5 and described below.

Figure 2:
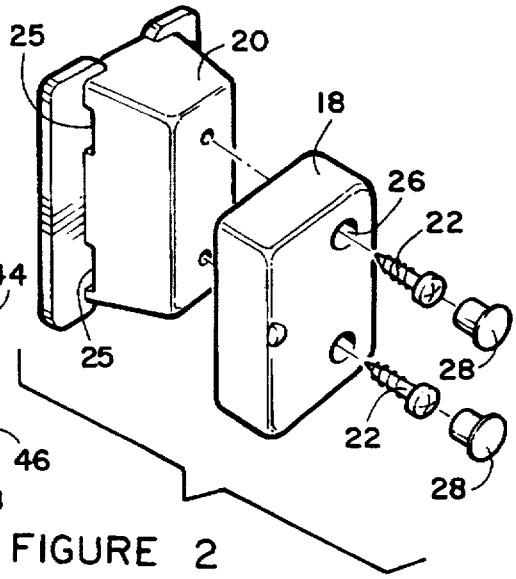
FIG. 2 is an exploded perspective view of the magnet housing and mounting assembly.

A magnet housing 32 is mounted on a pedestal 34 by screws, in the same manner as shown in FIG. 2 for the switch housing 18. Straps 36 extend through slots 38 in pedestal 34 to hold the magnet housing 32 to gate or frame tube 40. A conventional permanent magnet (not shown) is contained within magnet housing 32. Magnet housing 32 could also be mounted directly on a tube 40 with screws 22 or by double sided foam tape, as preferred.

When the gate is closed, magnet housing 32 is closely adjacent to switch housing 18, so that the magnet within the magnet housing will typically keep the switch open and the alarm in a stand-by state. When the gate is opened, magnet housing 32 and switch housing 18 are moved apart, allowing the switch to close, activating the alarm. If desired, a normally open switch means could be used, to open when the magnet and switch housings are moved apart, with that change in state being sensed at the microprocessor to trigger the alarm.

A pass/reset button 42 on housing 10 disables the alarm for a predetermined time, to allow a person to open the gate, pass through and close the gate without activating the alarm. Button 42 is sealed, typically by a flexible plastic or rubber cover film or the like to prevent water from entering housing 10. To aid a person in finding button 42 at night, a pattern of raised bumps 44 (here, two spaced at the sides of button 42) is provided so that the button location can be found by feeling the housing surface. Preferably, a label (not shown) is placed on the surface of the housing to identify the button when the area is lighted.

If desired a second (or more) reset switch button 46 could be provided, wired in parallel with the switch button 42 on alarm housing 16. The second switch button could be placed on the opposite side of the gate so that it could be pressed by a person coming from the opposite direction who needed to pass through the gate.

A battery and alarm check button 46 is also provided on the surface of housing 10. Pressing button 46 will cause the alarm to sound so long as the button is pressed if the battery is good. The button can also be pressed to call for assistance from persons in the area. If the alarm does not sound when button 46 is pressed, either the battery is too low or the alarm is defective. Which of these is the case can be easily determined by replacing the battery with one known to be good. So that button 46 can be easily found in the dark, a pattern of raised bumps 48 (here an arrowhead-like array of bumps 48, pointing toward the button) will aid in finding the button by feel.

Preferably, a circular recess 50 is formed in the surface of housing 10. The alarm speaker (not shown) is located directly behind recess 50. I have found that this recess seems to amplify the volume of the alarm speaker.

Figure 3:
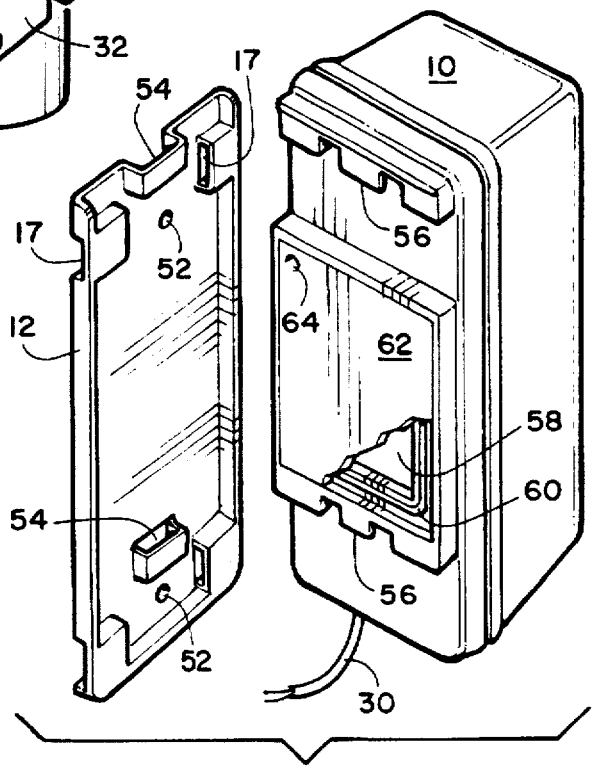
FIG. 3 is a perspective view of the back of the alarm housing and mounting bracket.

Details of the connection between alarm housing 10 and mounting bracket 12 are shown in FIG. 3. Bracket 12 has holes 52 through which conventional screws can be threaded to mount bracket 12 on a wooden gate or one made from some other similar material. In that case, straps 16 would not be required. Transverse slots 17 are provided to receive straps 16, when used.

Two vertical tubular members 54 are formed near the upper and lower ends of bracket 12. Two correspondingly sized, downwardly extending, tongues 56 are formed on the back of housing 10, so that sliding tongues 56 into tubular members 54 will secure the housing to the bracket. While rain water and the like may pass between the unit and bracket 12, the water cannot enter the unit.

A cavity 58 is provided in the back of alarm housing 10 to hold batteries (not shown) that power the alarm. A rubbery seal 60 is provided along a ledge along the edges of cavity 58 against which cover 62 presses when fastened in place by screws 64. Thus, the entire alarm housing 10 is sealed against moisture entry. The batteries can be easily replaced simply by lifting alarm housing 10 upwardly clear of bracket 12, then removing screws 64 and cover 62.

Figure 4:
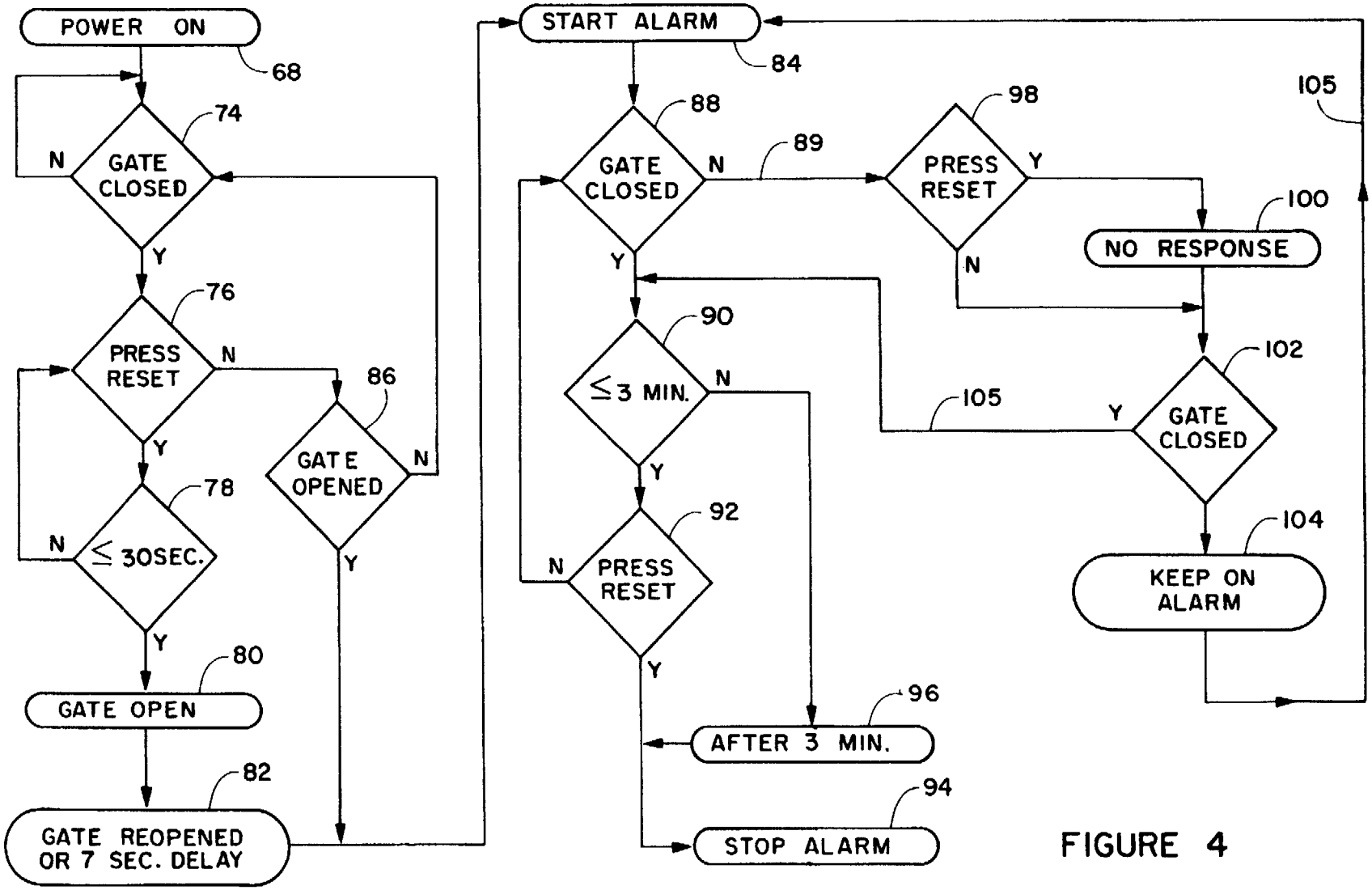
FIG. 4 is a flow diagram of the alarm operating sequence.

FIG. 4 provides a schematic flow diagram for the operation of the alarm system of this invention. Power to the electronic circuit and the various switches is automatically on, as indicated at 68 when a battery is installed in cavity 58 and will remain on until the battery is discharged or removed. A system on-off switch is highly undesirable, since it could be inadvertently turned off and the gate would not be protected. Further, the microprocessor 70 in the electronic circuit of FIG. 5 is preferably programmed to signal a low battery condition by periodically emitting a short alarm "beep", typically a 1 second beep every 60 seconds, to alert passers-by that the battery needs replacement.

At the gate closed point 74, if the gate is closed the alarm is in the standby state. When the gate is first closed after the battery is installed, it will begin to execute the programmed functions. The alarm is not enabled until the first closing of the gate. Thereafter, if an adult wishes to pass through the gate he or she presses reset switch button 42, as indicated at 76. The gate may be opened within a predetermined time period, generally up to about 30 seconds, as indicated at 78. The gate is opened as indicated at 80, the person passes through and the gate is closed. If the gate is opened, as indicated at 86, without pressing reset the alarm will immediately begin to sound, as shown at 84.

If the pass switch is pressed (76) and the gate is not opened within about 30 seconds, and the gate is opened after the 30 seconds have expired, the alarm will sound.

If the gate is reopened after being closed or a predetermined time during which the gate is left open has passed, typically about 7 seconds, as indicated at 82, a signal is generated to start sounding the alarm, as shown at 84. If the reset switch button was not pressed at block 76, and the gate is opened as indicated at 86, an immediate signal will be generated, starting alarm sounding per block 84.

Once the alarm begins to sound, it can be turned off only by closing the gate, as indicated at 88 and pressing reset as indicated at 92 within 3 minutes. However, the alarm will continue to sound for a predetermined time, up to about 3 minuets as indicated in block 90, unless the gate is closed and the reset button is pushed, as described above. If the both closing the gate and pressing reset are not done, nothing can stop the alarm short of removing the battery.

If the gate is not closed, as indicted at 80 but the reset button is pushed as indicated at 98, there will be no response to the reset as indicated at 100 and the alarm will continue. If the gate is not closed as indicated at 102, when the reset button is pushed, the alarm will continue as indicated at 104. If the gate is closed after (102) the reset button is pushed (98), the signal will return to the cycle via 105, so that the reset button may be pushed within 3 minutes (90, 92) to turn off the alarm.

Figure 5:
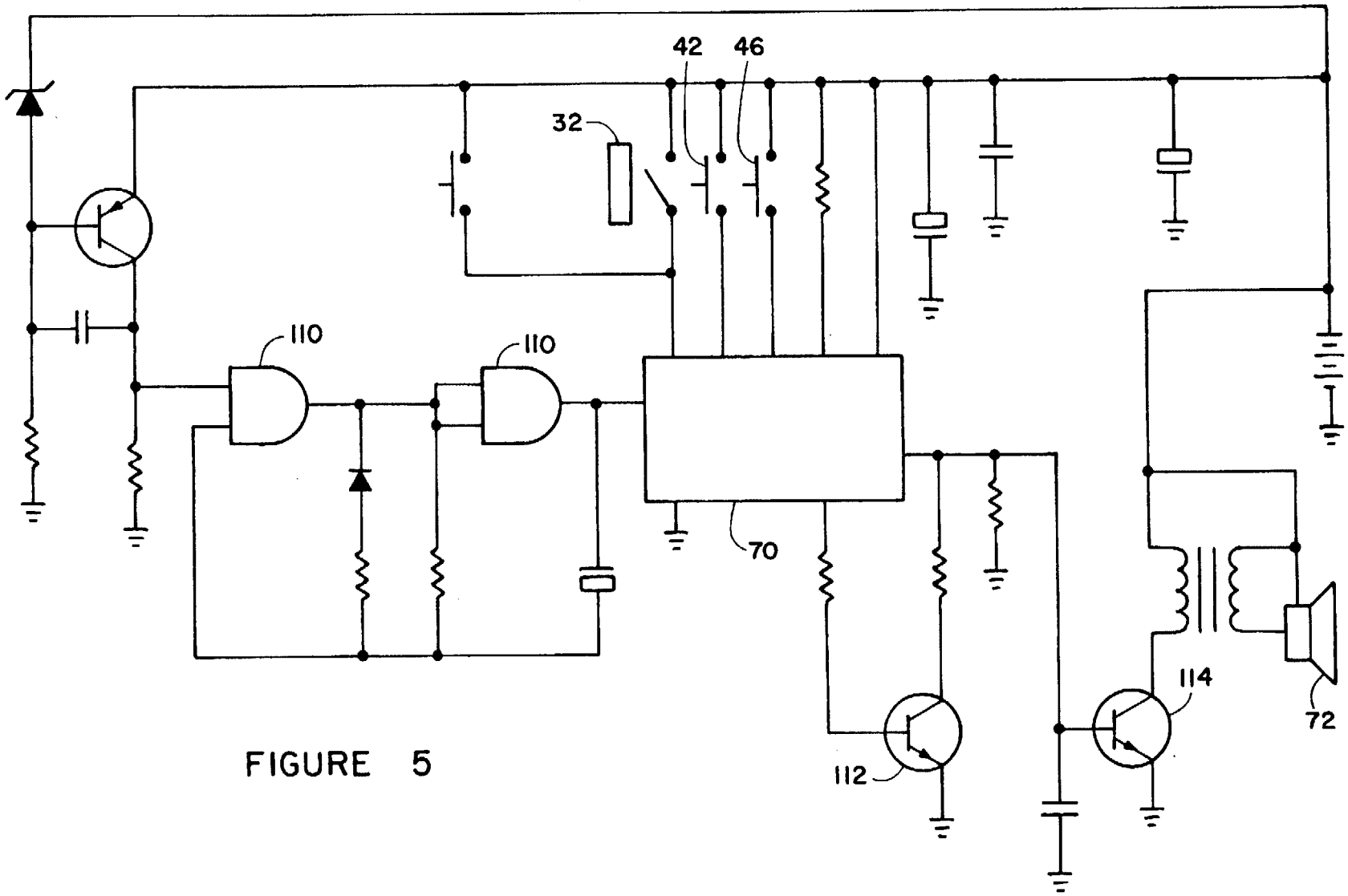
FIG. 5 is a schematic circuit diagram of the alarm operating circuit.

A preferred embodiment of an electronic circuit for operating the alarm is schematically shown in FIG. 5. Any other suitable circuit that will provide the functions as detailed above may be used. Basically, the various time periods described above and other varying parameters are provided by programming integrated circuit 70. Speaker 72, typically a piezoelectric speaker is powered through a circuit including npn transistors 112 and 114.

The CPU is preferably programmed to allow a battery to be placed in battery cavity 58 without activating the alarm speaker until the magnet housing 32 and switch housing 18 have been brought together for the first time, so that the alarm will not sound during installation and will only begin operation after installation is complete and the gate is closed for the first time. When the microprocessor detects the reed switch opened for the first time, it will enable its programmed functions. Also, the low battery system can be programmed, in the same manner that smoke alarms are sometimes programmed, to emit a short, typically no more than 2 second alarm "beep" every 10–60 seconds when the battery is low to alert passers-by that the battery should be replaced.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A gate opening alarm system which comprises:

an alarm housing;

a mounting bracket;

means for releasably securing a first side of said alarm housing to said mounting bracket;

means for securing said mounting bracket to one of a gate and a gate frame in a gate;

a magnet housing assembly including a magnet housing and means for mounting said magnet housing to the other of said gate and a gate frame;

a permanent magnet within said magnet housing;

a switch housing assembly including a switch housing and means for mounting said switch housing to said one of a gate and a gate frame closely adjacent to said magnet housing;

a magnetically actuatable alarm switch within said switch housing to change state when said gate is opened and said switch housing and magnet housing are moved apart;

electronic circuit means within said alarm housing and connected to said alarm switch for immediately sounding an audible alarm upon detecting said switch changed state;

said electronic circuit means further including means for canceling said reset switch alarm disabling if said switch and maanet housings are not moved apart by opening the gate within a predetermined time period;

manually operable reset switch means on said alarm housing and connected to said electronic means for disabling said audible alarm for a predetermined period; and battery means removably contained in said alarm housing for powering said electronic circuit means.

2. The gate opening alarm system according to claim 1 wherein said electronic circuit means includes means for causing said alarm to sound for a first predetermined time period when said switch and magnet housings are moved apart by opening said gate without first operating said reset switch, to inactivate the alarm for a second predetermined period after alarm actuation and to again actuate the alarm for another first predetermined time period if the switch and magnet housings have not been returned to close proximity by closing said gate and continuing a cycle of alarm activation and inactivation until said switch and magnet housings are returned to close proximity by closing said gate.

3. The gate opening alarm system according to claim 1 further including at least one additional reset switch for mounting on a gate side opposite the location of the first reset switch to permit disabling of said alarm from both sides of the gate.

4. The gate opening alarm system according to claim 1 wherein said electronic circuit means further includes means for initially preventing alarm operation until said alarm housing and switch housing have been brought together once and separated to permit installation of a battery in said alarm housing and installation of said alarm assembly on a gate without having the alarm sound.

5. The gate opening alarm system according to claim 1 wherein said electronic circuit means includes means for detecting a low battery state and for causing said alarm to operate for periods of up to about 2 seconds at predetermined intervals when a low battery state is detected.

6. The gate opening alarm system according to claim 1 wherein said means for releasably securing said alarm housing to said mounting bracket comprises at least one transverse slotted member on said mounting bracket and at lease one cooperating downwardly extending tongue on said alarm housing for insertion into said slotted member to releasably retain said alarm housing against said mounting bracket.

7. The gate opening alarm system according to claim 1 wherein said means for securing said mounting bracket to one of a gate and gate frame comprises at least two holes through said mounting bracket and screws for insertion through said holes and treading into said gate or gate frame.

8. The gate opening alarm system according to claim 1 wherein said means for securing said mounting bracket to one of a gate and gate frame comprises at least two transverse slots in said mounting bracket and a strap means for passing through said transverse slots and around a part of said gate or gate frame.

9. The gate opening alarm system according to claim 1 wherein said means for mounting said magnet housing and means for mounting said switch housing each comprises holes through the respective housings, screws for insertion into said holes and threading into said gate or gate housing and plugs for covering said holes.

10. The gate opening alarm system according to claim 1 wherein said means for mounting said magnet housing and means for mounting said switch housing each comprises holes through the respective housing, a pedestal, screws for insertion through said holes and threading into said pedestal, transverse slots through each pedestal and straps for passing through said transverse slots and around a part of said gate or gate frame.

11. The gate opening alarm system according to claim 1 wherein said switch is a magnetically operated reed switch.

12. The gate opening alarm system according to claim 1 further including a manually operable battery and alarm check switch connected to said electronic circuit means to cause said alarm to sound while actuated.

13. The gate opening alarm system according to claim 12 further including raised indicia on said alarm housing adjacent to said reset switch and said battery and alarm test switch to permit the switches to be located by feel at night.

14. The gate opening alarm system according to claim 1 further including a cavity in said first side of said alarm housing for receiving said battery means and cover for closing said cavity, said cover including a compressible gasket for sealing said cavity against moisture intrusion.

15. A gate opening alarm which comprises:

an alarm housing;

a mounting bracket;

means for releasably securing said alarm housing to said mounting bracket;

means for securing said mounting bracket to one of a gate and a gate frame in a gate;

a magnet housing assembly including a magnet housing and means for mounting said magnet housing to the other of said gate and a gate frame;

a permanent magnet within said magnet housing;

a switch housing assembly including a switch housing and means for mounting said switch housing to said one of a gate and a gate frame closely adjacent to said magnet housing;

a magnetically actuatable alarm switch within said switch housing to change state when said gate is opened and said switch housing and magnet housing are moved apart;

electronic means within said alarm housing and connected to said alarm switch for immediately sounding an audible alarm upon actuation of said alarm switch;

manually operable reset switch means on said alarm housing and connected to said electronic means for disabling said audible alarm for a period of from about 5 to 10 seconds to permit opening the gate without said alarm sounding;

a manually operable battery and alarm check switch connected to said electronic circuit means to cause said alarm to sound while actuated;

said electronic circuit means including means for canceling said reset switch alarm disablement if said gate is not opened within a predetermined time period;

battery means removably contained in said alarm housing for powering said electronic circuit means.

16. The gate opening alarm system according to claim 15 wherein said electronic circuit means includes means for causing said alarm to sound for a first predetermined time period when said switch and magnet housings are moved apart by opening said gate without first operating said reset switch, to inactivate the alarm for a second predetermined period after alarm actuation and to again activate the alarm for another first predetermined time period if the switch and magnet housings have not been returned to close proximity by closing said gate and continuing a cycle of alarm activation and inactivation until said switch and magnet housings are returned to close proximity by closing said gate.

17. The gate opening alarm system according to claim 15 further including a manually operable battery and alarm check switch connected to said electronic circuit to cause said alarm to sound while actuated.

18. The gate opening alarm system according to claim 15 further including a cavity in a first side of said alarm housing for receiving said battery means and cover for closing said cavity, said cover including a compressible gasket for sealing said cavity against moisture intrusion.

* * * * *